United States Patent [19]

Waggener

[11] Patent Number: 4,654,019

[45] Date of Patent: Mar. 31, 1987

[54] INVERTED TOROID TOY

[76] Inventor: Thomas B. Waggener, 907 Watertown St., West Newton, Mass. 02165

[21] Appl. No.: 707,642

[22] Filed: Mar. 4, 1985

[51] Int. Cl.[4] ..... A63H 3/12

[52] U.S. Cl. ..... 446/321; 446/491; 446/490

[58] Field of Search ..... 446/491, 486, 489, 490, 446/267, 321, 369, 372, 147; 2/16, 59, 170, 242; 272/8 N, 8 R

[56] References Cited

U.S. PATENT DOCUMENTS

| | | | |
|---|---|---|---|
| D. 175,089 | 7/1955 | Newmark | 446/267 X |
| 699,802 | 5/1902 | Mendelsohn | 2/59 X |
| 1,815,530 | 7/1931 | Stone | 2/16 X |
| 3,347,545 | 10/1967 | Nichols | 446/267 X |

FOREIGN PATENT DOCUMENTS 56-4065 1/1981 Japan .

*Primary Examiner*—Mickey Yu
*Attorney, Agent, or Firm*—Herbert L. Bello; M. Lawrence Oliverio

[57] ABSTRACT

A new toy is provided which, because its topology is that of an inverted toroid, can present multiple appearances and can rapidly change appearances. The toy may be continually manipulated, in a motion similar to turning a pair of socks inside-out, to present a new surface and thus a new appearance with each such action. In a preferred embodiment, the toy is composed of several segments of cloth with elastic and two cloth tabs with grommets at each junction of two segments. The outer surface of the toy is typically formed by a single segment of the cloth with the other segments enclosed. When the segments are distinguished from one another such that each has a different appearance, manipulating the toy so as to bring another segment to the outer surface causes the toy to present a new appearance. Two constraining loops, each going through a set of the aforementioned grommets, act to limit the overall exterior dimension of the toy and facilitate smooth functioning of the toy.

The segments may have indicia thereon representing groups of objects, people, animals, vegetables, alphabetic and/or numeric characters.

14 Claims, 4 Drawing Figures

INVERTED TOROID TOY

REFERENCES CITED

U.S. Patent Documents Nos.

1,099,208
1,289,715
2,195,127
3,791,068
4,336,665
4,373,292

BACKGROUND OF THE INVENTION

Cloth toys for all ages from infants to adults have been manufactured and patented. These toys are typically distinguished from one another by the objects they represent, for example teddy bears, stuffed animals, various vegetable, dolls representing any number of characters fictitious or real.

There exist dual character dolls which have been patented. U.S. Pat. No. 4,373,292 discloses a dual character doll, the front presenting one character and the back presenting another, which has a fastening means for joining a second similar dual character doll at or near the hands. By joining two or more dolls together groups of dolls representing a family or an associated group may be formed, e.g. doctor/nurse, mother/father, boy/girl, grandmother/grandfather, fireman/policeman.

Other patents which disclose dual faced dolls include U.S. Pat. Nos. 3,791,068, 1,289,715, and 1,099,208.

A convertible stuffed toy disclosed by U.S. Pat. No. 4,336,665 can present either of two manifestations by flipping a shell cover over one end or the other. The toy is comprised of two soft generally round head members, each head member having a face portion and a neck portion. The two head members are joined at the neck portion with the face portions disposed toward opposite directions and the reversible shell fabric connected to these members at the neck juncture. The sheell fabric can be flipped over one head or the other to present either of the two manifestations.

SUMMARY OF THE INVENTION

The instant invention is a toy which, owing to the nature of its topology, can present multiple appearances, can rapidly change appearances and can provide hours of fascination to its owner. The instant invention may be continually manipulated, in a motion similar to turning a pair of socks inside-out, to present a new surface and thus a new appearance with each such action. The instant invention has the topological form of an inverted toroid (a doughnut turned inside-out), and is composed of a number of segments, each of tubular topology, with elastic at each junction between segments. Typically a single segment forms the outside surface which encloses the other segments within. The toy presents a new appearance each time a new segment is brought to the outside to form the outer and visible side of the toy via the aforementioned manipulation. Because of its inverted toroidal topology, the toy may be continuously manipulated, time and again bringing another interior segment to form the outer, visible surface, although the number of new appearances of the toy is limited to the number of segments of which it is constructed, e.g., if the toy is composed of seven segments and segment number 1 forms the outer surface and the toy is repetitively manipulated so as to bring a new segment to the outer surface with each such manipulation, each segment in sequence will form the outer surface and after the seventh such manipulation segment number 1 will again form the outer surface. The toy is conceived as being constructed of cloth or fur-like material and may have one or more internal constraining loops, as of nylon line, which limit the overall exterior dimension of the toy and facilitate smooth sequential manipulation of the toy.

DETAILED DESCRIPTION OF A PREFERRED EMBODIMENT

Figure 1:
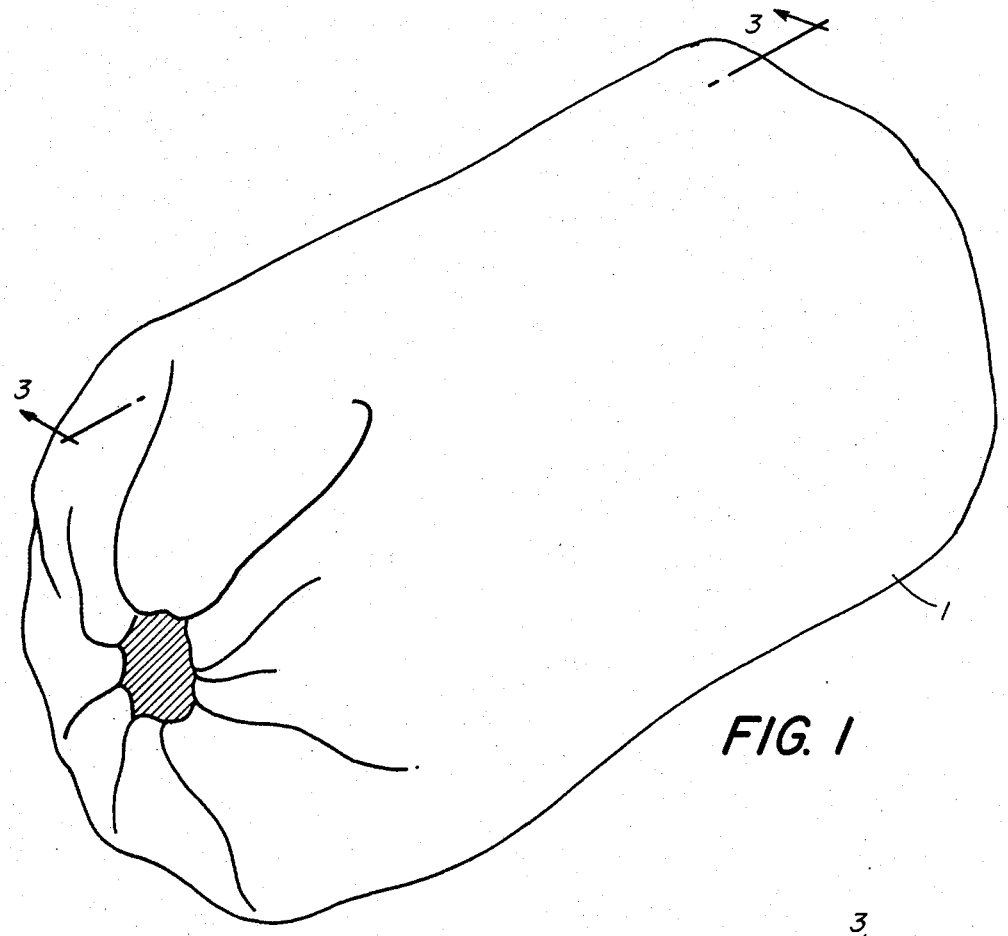
FIG. 1 is a perspective view of one end portion of the toy.
Figure 2:
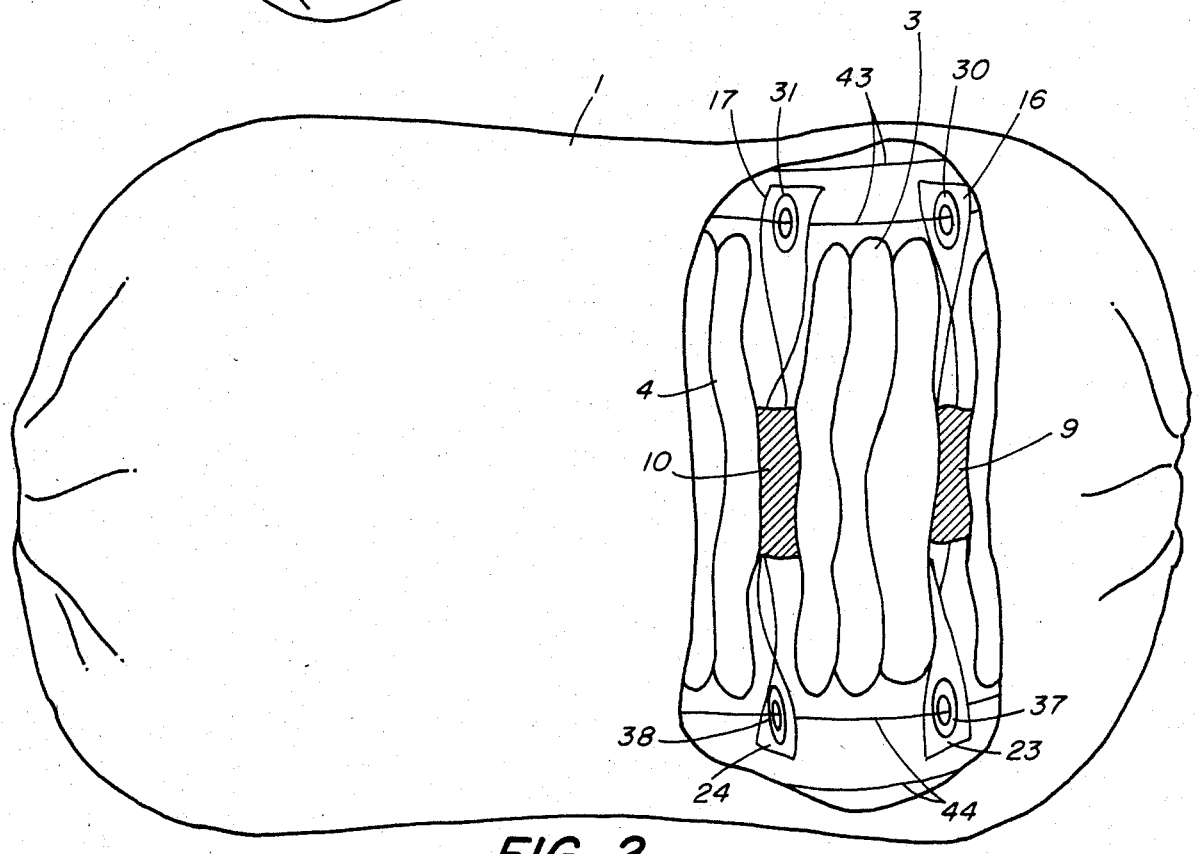
FIG. 2 is a side elevational fragmentary view of the toy with a portion of the outer surface, 1, cut away to reveal the enclosed segments, and the tabs, grommets, and elastic at the junctions between segments.
Figure 3:
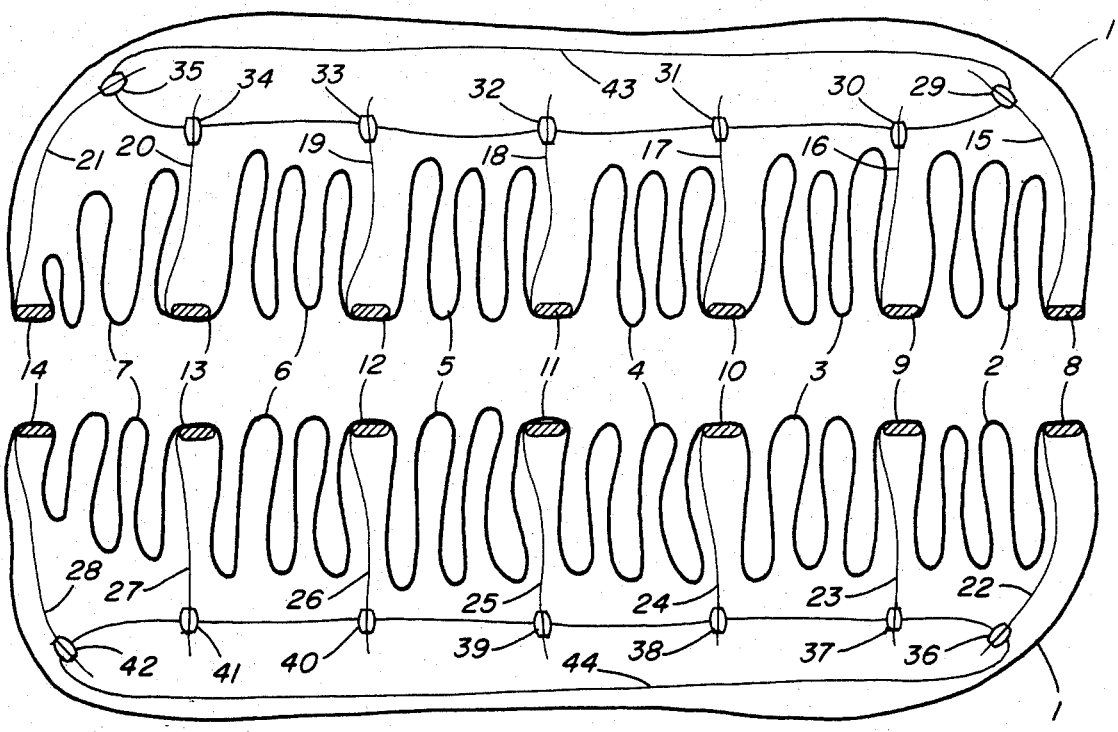
FIG. 3 is a sectional view of FIG. 1 and taken along line 3—3.

A new toy is described which provides multiple appearances. In this embodiment, the toy is constructed of seven segments of soft cloth each of which is sewn into the shape of an open-ended tube and then joined together with the other segments to form an inverted toroid and each segment, labeled 1 through 7 in the Figures, of the toy is of a different color. Eastic is sewn into each junction of two segments. At each junction of two segments, two cloth tabs with grommets through them are sewn roughly 180 degrees apart on the inside of the inverted toroid. A line, in this particular case a nylon line, is passed through each set of grommets and then secured to itself to form a constraining loop. In this embodiment there are two constraining loops which limit the overall exterior dimensions of the toy and facilitate smooth functioning of the toy as each new segment is brought to form the outer surface. In FIG. 1, FIG. 2, and FIG. 3, the outer surface of the toy is formed by segment 1. In FIG. 3, it can be seen that the elastic, 8 and 14, at either end of the toy help to enclose the inner segments, 2,3,4,5,6, and 7. In this embodiment the inner segments act as a stuffing which gives the toy weight and form. In FIG. 3 the elastic at each junction between segments can be seen. The elastic is labeled 8, 9, 10, 11, 12, 13, and 14. Also seen at each junction are the tabs, labeled 15, 16, 17, 18, 19, 20, 21, 22, 23, 24, 25, 26, 27, and 28, and the grommets through each tab. The grommets are labeled 29, 30, 31, 32, 33, 34, 35, 36, 37, 38, 39, 40, 41, and 42. In this embodiment one of the two constraining loops is labeled 43 and passes through grommets 29, 30, 31, 32, 33, 34, 35, and the other is labeled 44 and passes through grommets 36, 37, 38, 39, 40, 41, and 42. Illustrating the capability of this toy to provide multiple appearances, in FIG. 4, a new segment, segment 2, has been exposed as the outer surface and segment 1 has become one of the inner segments along with segments 3, 4, 5, 6, 7. By a similar sequence each segment in turn may become the outer surface while the remainder of the segments are the inner segments.

Figure 4:
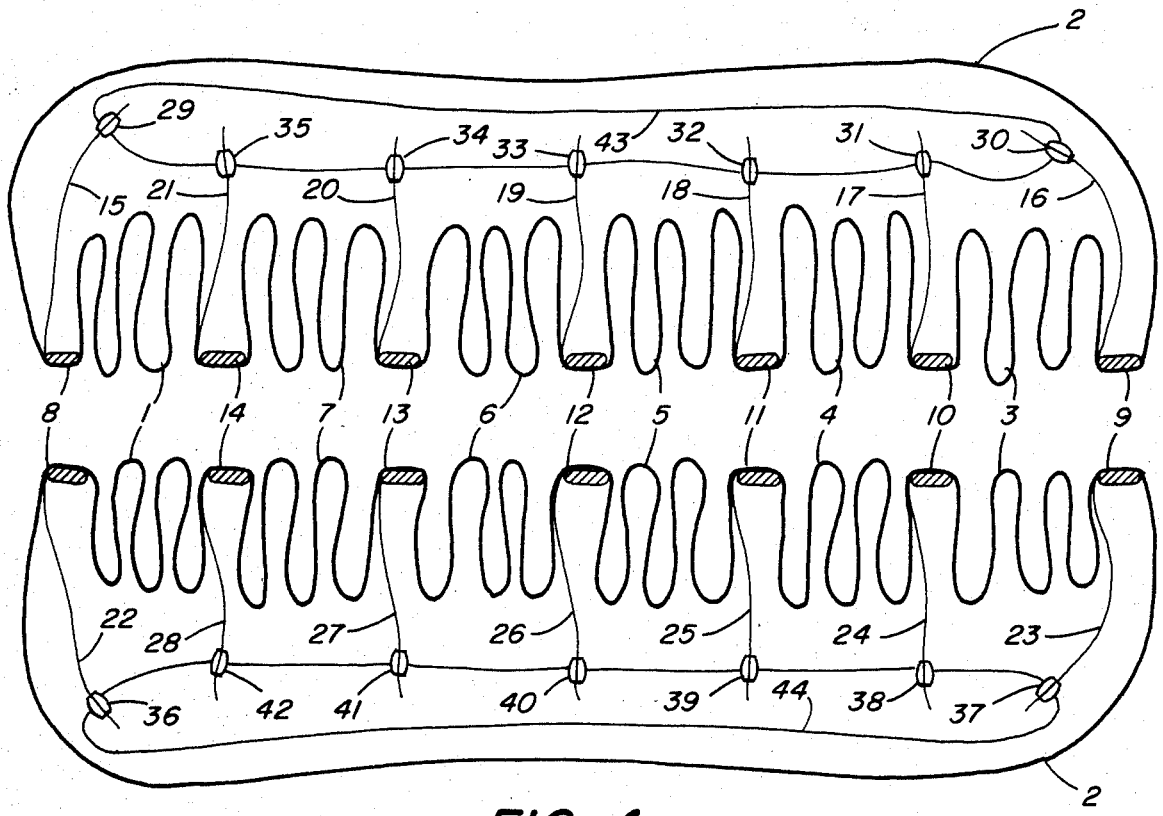
FIG. 4 is the same sectional view as FIG. 3 but taken after the toy has been through one manipulation so that segment 2 rather than segment 1 is exposed as the outer surface of the toy.

As shown in FIGS. 3 and 4, the segments forming the inner surface are folded and the segment forming the outer surface lies substantially flat. Although the length of the segments are substantially equal, the longitudinal distance of the segment forming the outer surface is substantially equal to the total longitudinal distance of the folded sections forming the inner surface.

Each segment may be of a different color, material or design such that as each segment forms the outer surface, the toy presents a new appearance. For example, if each segment is of a different color, then each time a new segment becomes the outer surface the toy appears to have changed color. Another example is for each segment to represent a person and to have the entire toy represent a related group, such as a family. In such a case one segment might represent a father, another segment a mother, another segment a boy, another segment a girl, another segment a grandfather, and another segment a grandmother. A wide variety of such groupings are possible including groups of objects, animals, vegetables, people, alphabetic and/or numeric characters.

While the invention has been disclosed herein in connections with certain embodiments and detailed descriptions, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A toy having the topology of an inverted toroid, said toy comprising:
   (a) at least three segments joined together, said segments composed of a flexible material; and
   (b) an elastic at each junctions of said joined segments;
   (c) said segments joined together in such a manner that one of said segments forms the outer surface of said toy while the other ones of said segments are enclosed, and each said segment may sequentially become the outer surface of said toy while the other ones of said segments become the inner surface of said toy, thus allowing said toy to present multiple appearances, the longitudinal distance covered by said segment forming the outer surface being substantially equal to the longitudinal distance covered by said segments forming the inner surface.

2. The toy of claim 1 having segments of different colors.

3. The toy of claim 1 having segments of cloth of different composition or texture.

4. The toy of claim 1 having segments which are provided with indicia representing a family group.

5. The toy of claim 1 having segments which are provided with indicia representing animals, vegetables or objects.

6. The toy of claim 1 having segments which are provided with indicia representing alphabetic or numeric characters.

7. The toy of claim 1 having segments which are provided with indicia representing scenes in a story.

8. A toy having the topology of an inverted toroid, said toy comprising:
   (a) at least two segments joined together, said segments composed of a flexible material;
   (b) an elastic at each junction of said joined segments;
   (c) said segments joined together in such a manner that one of said segments forms the outer surface of said toy while the other one of said segments is enclosed, and each said segment may sequentially become the outer surface of said toy while the other of said segments becomes the inner surface of said toy, thus allowing said toy to present multiple appearance; and
   (d) at least one internal constraining loop operatively connected to said segments, said constraining loop limiting the exterior dimension of said toy.

9. The toy of claim 8 having segments which are provided with indicia of different colors.

10. The toy of claim 8 having segments of cloth of different composition or texture.

11. The toy of claim 8 having segments which are provided with indicia representing a family group.

12. The toy of claim 8 having segments which are provided with indicia representing animals, vegetables, or objects.

13. The toy of claim 8 having segments which are provided with indicia representing alphabetic or numeric characters.

14. The toy of claim 8 having segments which are provided with indicia representing scenes in a story.

* * * * *